US006840261B2

(12) United States Patent
Huang

(10) Patent No.: US 6,840,261 B2
(45) Date of Patent: Jan. 11, 2005

(54) GAS VALVE SWITCH STRUCTURE OF GAS STOVE

(75) Inventor: Chin-Ying Huang, Taichung (TW)

(73) Assignee: HON Technology Inc., Muscatine, IA (US)

( * ) Notice: Subject to any disclaimer, the term of this patent is extended or adjusted under 35 U.S.C. 154(b) by 0 days.

(21) Appl. No.: 10/364,288

(22) Filed: Feb. 10, 2003

(65) Prior Publication Data

US 2003/0183273 A1 Oct. 2, 2003

Related U.S. Application Data

(63) Continuation of application No. 09/755,316, filed on Dec. 29, 2000, now Pat. No. 6,520,199.

(51) Int. Cl.[7] ..... F16K 27/00
(52) U.S. Cl. ..... 137/66; 137/881; 431/59
(58) Field of Search ..... 137/65, 66, 881; 431/54, 59

(56) References Cited

U.S. PATENT DOCUMENTS 3,999,932 A * 12/1976 Matthews ..... 137/66
5,447,287 A 9/1995 Kelly et al.
6,029,705 A 2/2000 Happe
6,520,199 B2 2/2003 Huang
6,537,058 B1 3/2003 Evans et al.

OTHER PUBLICATIONS

Robertshaw Controls Company; 2000 DER/IPER Gas Heating Controls; 4 Pages.
Robertshaw Controls Company; 2500 DER Gas Heating Control; 4 Pages.
Robertshaw Controls Company; 7000 LC Gas Heating Control; 4 Pages.
Robertshaw Controls Company; 2000 WIPER/WDER Gas Heating Controls; 4 Pages.

* cited by examiner

*Primary Examiner*—Gerald A. Michalsky
(74) *Attorney, Agent, or Firm*—Merchant & Gould P.C.

(57) ABSTRACT

A gas valve switch structure of a gas stove includes a top base, an aluminum plate, a sealing washer, two rubber washers two fixing pieces, a female base, and a protective plate. The protective plate is used for sealing the rubber washer and the fixing piece in the oblong hole of the female base. Then, the top base is screwed on the female base, with the aluminum plate and the sealing washer being clamped between the top base and the female base. The air storing chambers of the female base are closed while the rubber washer and the fixing piece are sealed in the oblong hole of the female base by provision of the aluminum plate and the sealing washer, and the gas valve switch structure of the gas stove achieves a gas triple safety switch by provision of the two electromagnetic valves and the control bolt.

24 Claims, 8 Drawing Sheets

GAS VALVE SWITCH STRUCTURE OF GAS STOVE

"This application is a continuation of application Ser. No. 09/755,316, filed Dec. 29, 2000, now U.S. Pat. No. 6,520, 199 which application(s) are incorporated herein by reference."

BACKGROUND OF THE INVENTION

1. Field of the Invention

The present invention relates to a gas valve switch structure of a gas stove.

2. Description of the Related Prior Art

The closest prior art of which the applicant is aware is disclosed in the Taiwanese Patent Publication No. 273879, entitled by "Gas Switch Device of a Water Heater", which discloses two magnetic members that are mounted in a water disk to actuate a transmission member so that the transmission member is deflected. The deflected transmission member drives a valve rod to displace linearly to open a hole which is used to control the valve.

However, such a conventional switch device has the following disadvantages.

1. The magnetic capacity of the magnetic member easily reduces during long-term utilization so that the valve cannot be closed completely, thereby affecting the safety of use.

2. The two magnetic members are easily displaced during operation, so that the two magnetic members are not aligned with each other, thereby reducing the magnetic capacity, so that the valve cannot be closed completely.

3. The closing action of the magnetic member is easily affected by other iron members, so that the valve cannot be closed completely.

SUMMARY OF THE INVENTION

The primary objective of the present invention is to provide a gas valve switch structure of a gas stove, wherein two electromagnetic valves are used to control upper and lower fixing pieces, thereby controlling input and output of gas, so as to achieve an electrical double safety switch.

Another objective of the present invention is to provide a gas valve switch structure of a gas stove, wherein a control bolt is used to control input of gas into a female base, thereby achieving a manually operated safety switch.

A further objective of the present invention is to provide a gas valve switch structure of a gas stove, wherein the top base has a pressure outlet hole and a pressure inlet hole for detecting pressure of inlet gas and outlet gas, thereby facilitating adjusting the pressure of gas.

A further objective of the present invention is to provide a gas valve switch structure of a gas stove, wherein the female base has two sides each defining a side hole for fitting a warming stove with different outlet directions.

In accordance with one aspect of the present invention, there is provided a gas valve switch structure of a gas stove comprising: a top base, an aluminum plate, a sealing washer, two rubber washers, two fixing pieces, a female base, and a protective plate, wherein, the top base, is substantially rectangular, and has a bottom defining an oblong hole, the oblong hole having a bottom defining an air draining hole, the top base having an upper end integrally defining two through holes, and a pressure outlet hole and a pressure inlet hole located between the two through holes, the two through holes each respectively fitted with a female fire electromagnetic valve and a main fire electromagnetic valve, the main fire electromagnetic valve having a top provided with a pressure regulating knob, the female fire electromagnetic valve being used to control movement of the fixing piece which is located above the female base, the main fire electromagnetic valve being used to control movement of the fixing piece which is located under the top base, the pressure outlet hole and the pressure inlet hole each respectively screwed with a bolt;

the aluminum plate, is a rectangular piece, and has a center defining an air draining hole, tile air draining hole having one side defining a rectangular hole and a plurality of circular holes;

the sealing washer, is a rectangular piece, and has a center defining an air draining hole, the air draining hole having one side defining a rectangular hole and a plurality of circular holes;

the rubber washer, is an oblong piece, and has a center integrally formed with a fixing bolt, and two ends each defining an air outlet hole, and a periphery defining a plurality of draining holes;

the fixing piece, is an oblong disk, and has a center defining a locking hole, and two ends each defining an air outlet hole;

the female base, is substantially rectangular, and has an inner portion integrally formed with a plurality rib walls for separating the inner portion into a first air storing chamber, a second air storing chamber, and a third air storing chamber, the female base having one side defining a female fire air outlet hole and a main fire air outlet hole, and the other side defining a fixing hole and an air inlet hole, and having two ends each defining a side hole the first air storing chamber communicating with the air inlet hole, the inner portion of the female base defining a channel so that the second air storing chamber communicates with the female fire air outlet hole, the female base having a bottom defining an oblong hole, the oblong hole having a bottom defining an air draining hole, a control bolt passing through the fixing hole, the control bolt having one end with a semi-cylindrical shape, and the other end fitted with a washer, and having a tail end screwed with a wrench, an air pressure valve secured in the first air storing chamber, the air pressure valve being a piece having a center provided with a protruding knob, and the semi-cylindrical end of the control bolt rested on a lower end of the air pressure valve;

the protective plate, is substantially rectangular, and has a center defining an oblong hole, the oblong hole having a center defining a circular recess;

wherein, the oblong holes of the top base and the female base each respectively receive a rubber washer, thereby closing the oblong hole by the rubber washer, the fixing bolt of the rubber washer is fitted with a fixing piece, the fixing piece defines a circular recess for receiving a spring, so that the fixing piece may be displaced on the fixing bolt, then the protective plate is used for sealing the rubber washer and the fixing piece in the oblong hole of the female base, then the top base is screwed on a top of the female base, with the aluminum plate and the sealing washer being clamped between the top base and the female base, the plurality of air storing chambers of the female base are closed while the rubber washer and the fixing piece of the top base are sealed in the oblong hole of the female base by provision of the aluminum plate and the sealing washer, and the gas valve switch structure of the gas stove achieves a gas triple safety switch by provision of the two electromagnetic valves and the control bolt.

Further benefits and advantages of the present invention will become apparent after a careful reading of the detailed description with appropriate reference to the accompanying drawings.

DETAILED DESCRIPTION OF THE INVENTION

Figure 1:
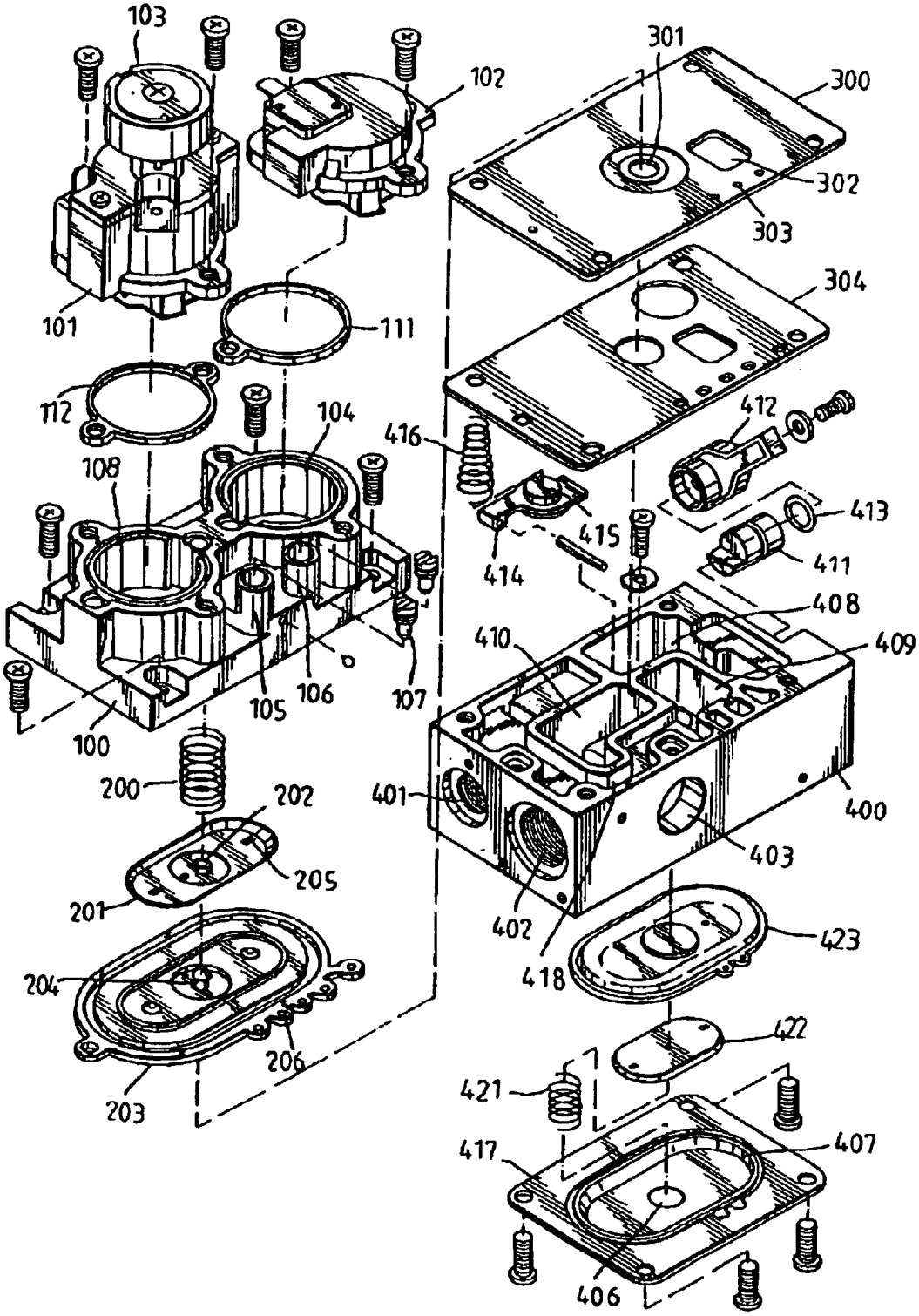
FIG. 1 is an exploded perspective view of a gas valve switch structure of a gas stove in accordance with the present invention.
Figure 2:
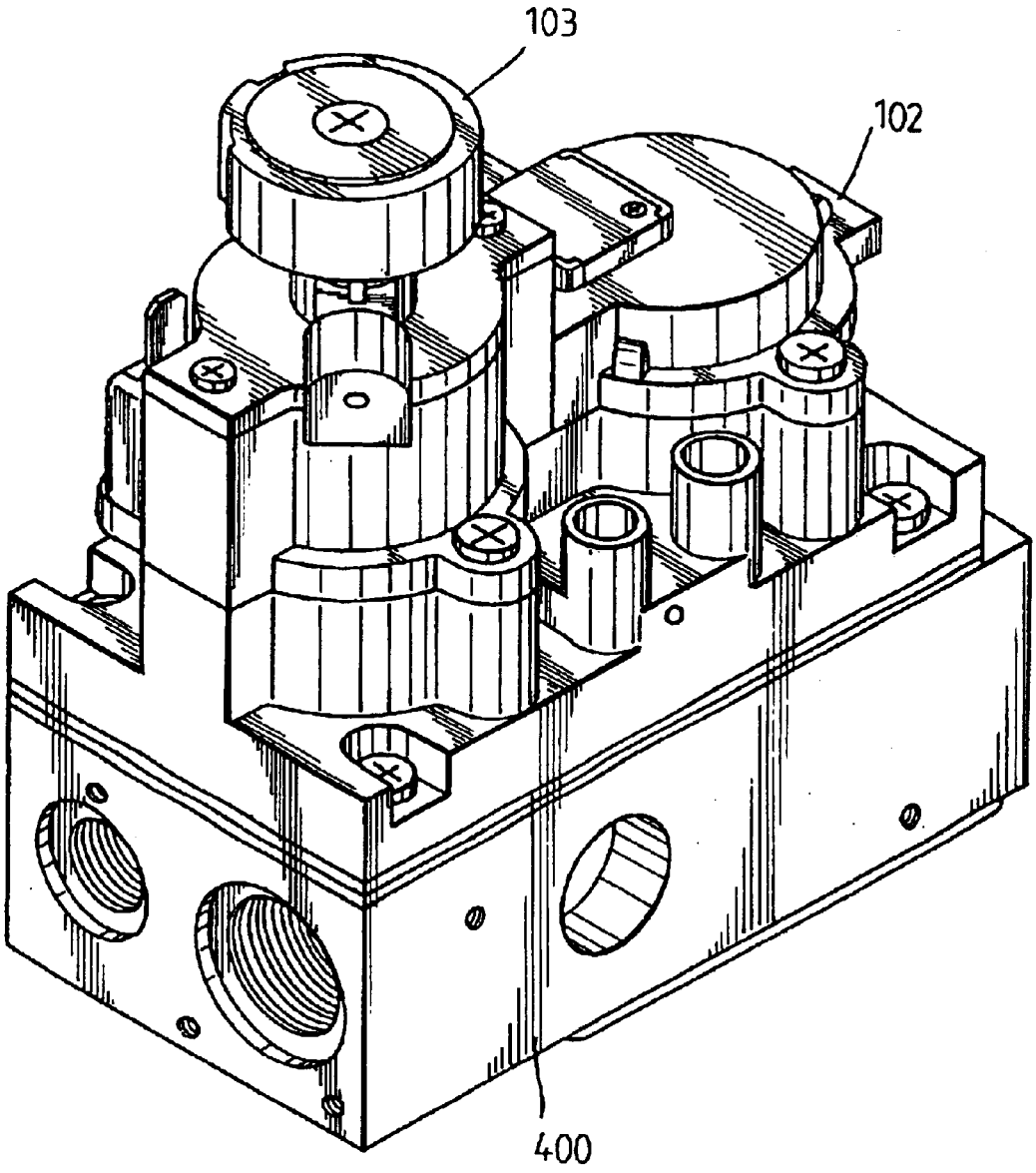
FIG. 2 is a perspective assembly view of the gas valve switch structure of a gas stove as shown in FIG. 1.
Figure 3:
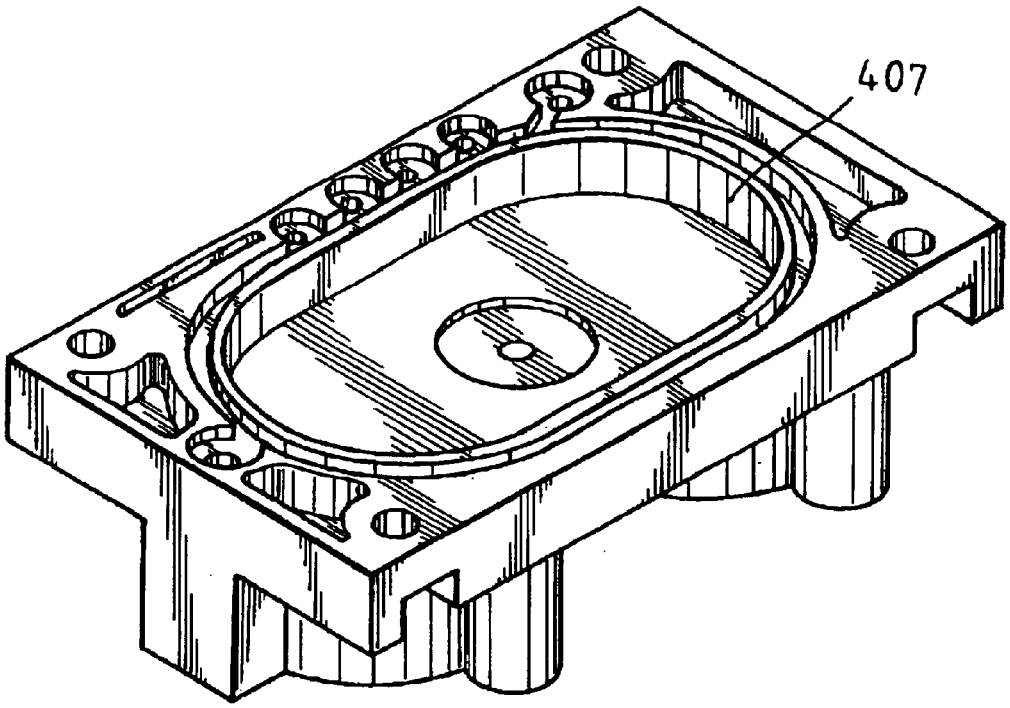
FIG. 3 is a bottom perspective view of a top base of the gas valve switch structure of a gas stove as shown in FIG. 1.
Figure 4:
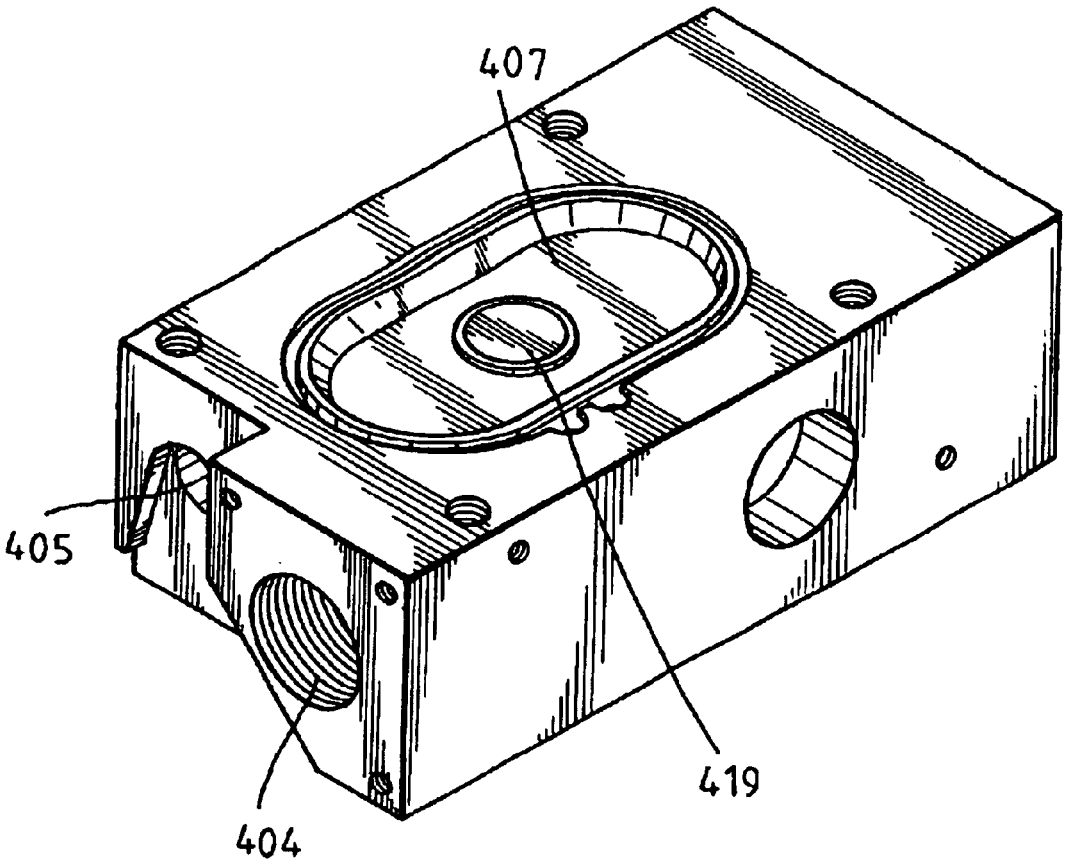
FIG. 4 is a bottom perspective view of a female base of the gas valve switch structure of a gas stove as shown in FIG. 1.
Figure 5:
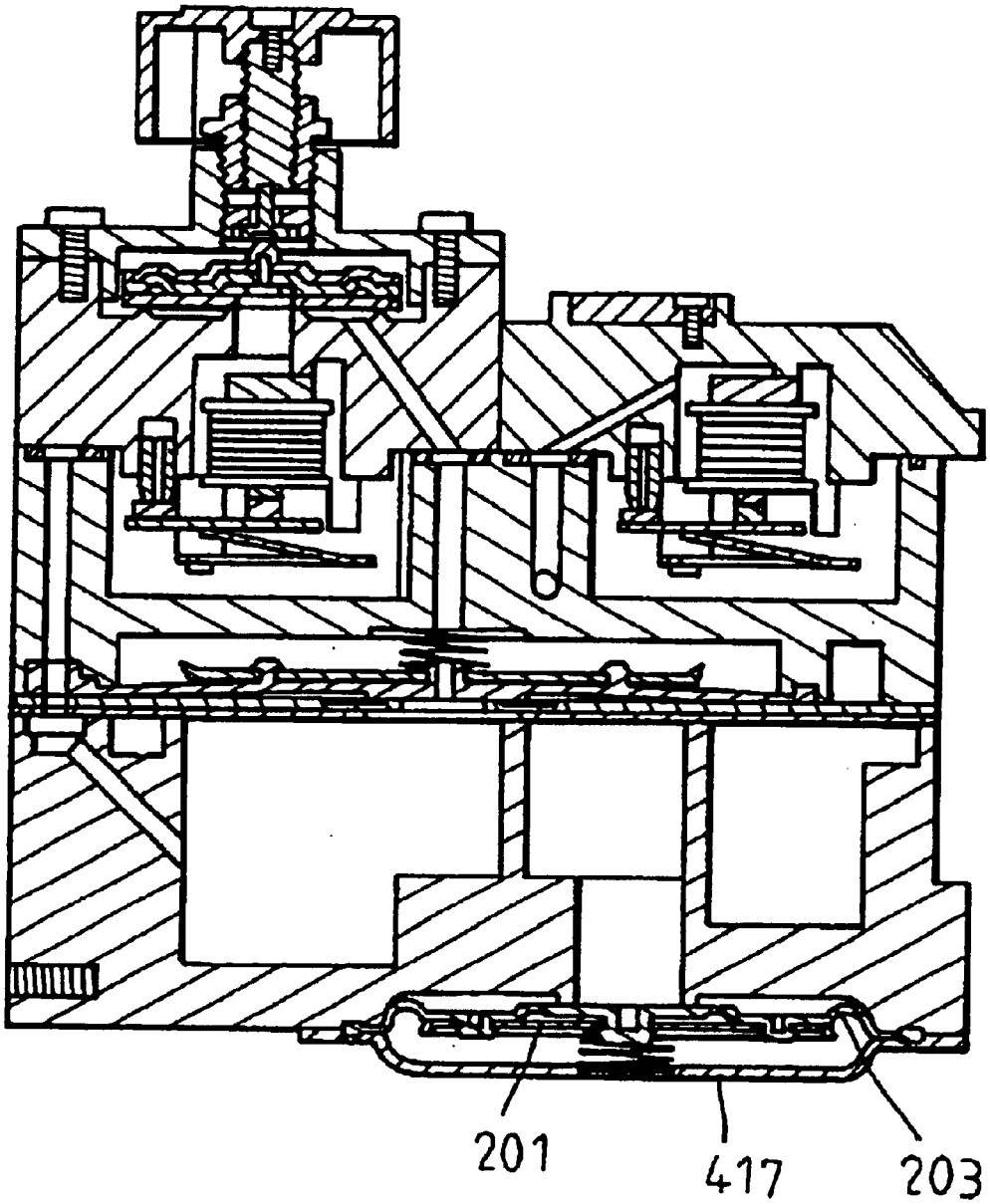
FIG. 5 is a front plan cross-sectional assembly view of the gas valve switch structure of a gas stove as shown in FIG. 1.
Figure 6:
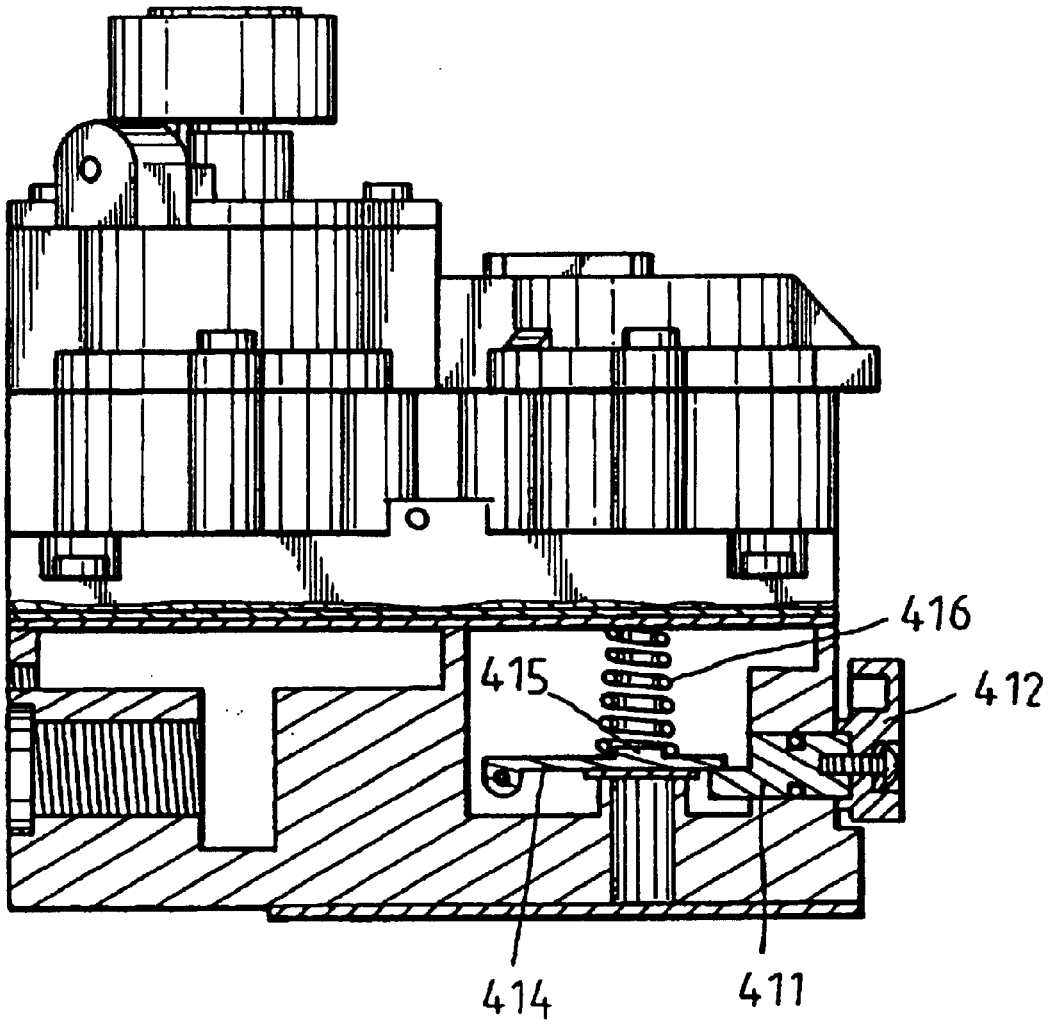
FIG. 6 is a front plan cross-sectional operational view of the gas valve switch structure of a gas stove as shown in FIG. 1.
Figure 7:
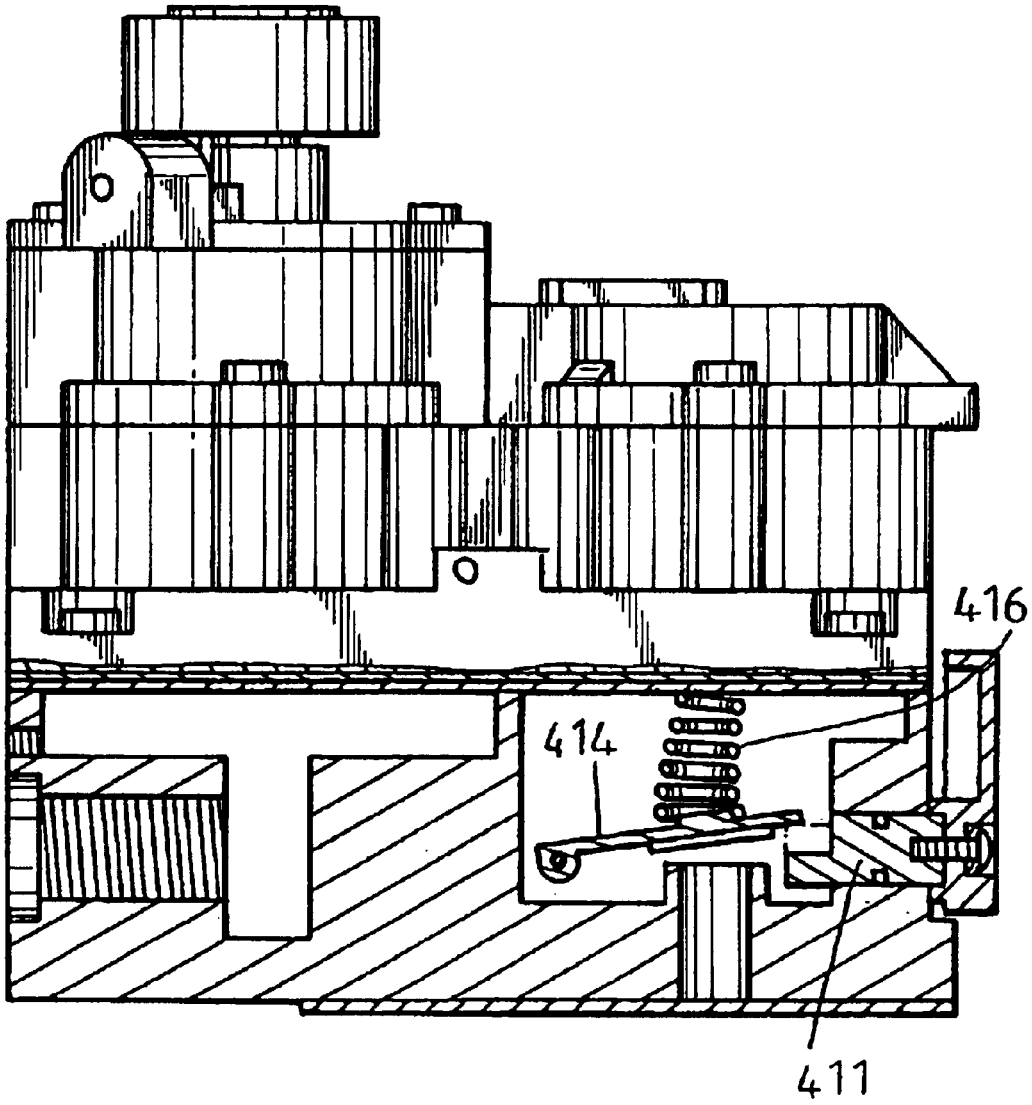
FIG. 7 is an operational view of the gas valve switch structure of a gas stove as shown in FIG. 6.
Figure 8:
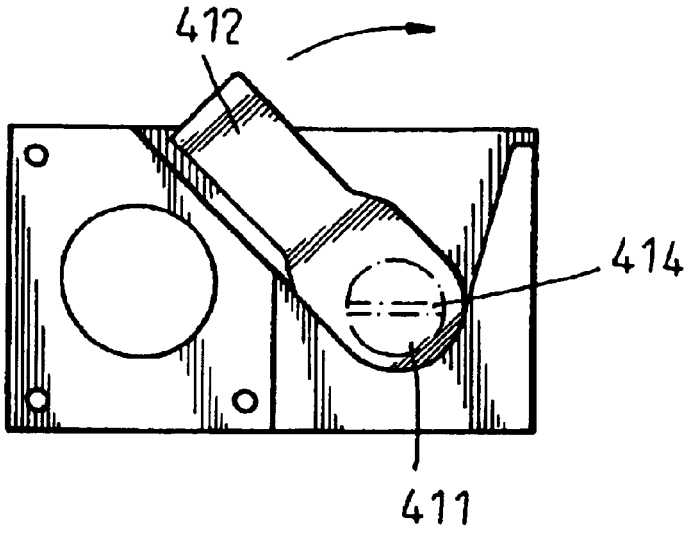
FIG. 8 is a side plan operational view of the gas valve switch structure of a gas stove as shown in FIG. 1.
Figure 9:
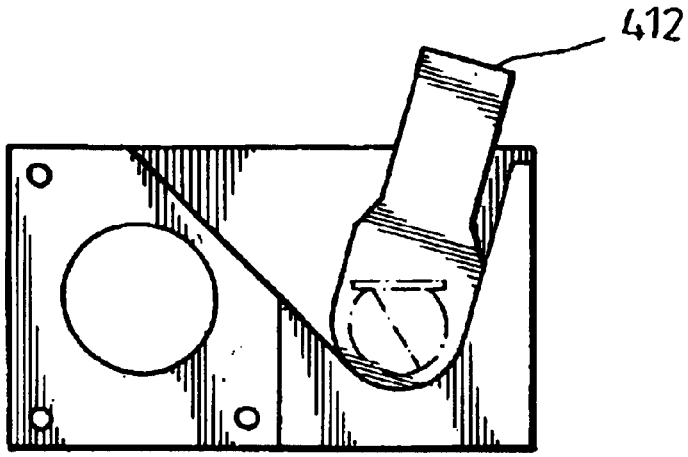
FIG. 9 is an operational view of the gas valve switch structure of a gas stove as shown in FIG. 8.

Referring to FIGS. 1–9, a gas valve switch structure of a gas stove in accordance with the present invention comprises a top base 100, an aluminum plate 300, a sealing washer 304, two rubber washers 203, two fixing pieces 201, a female base 400, and a protective plate 417.

The top base 100 is substantially rectangular and has a bottom defining an oblong hole 407. The oblong hole 407 has a bottom defining an air draining hole 419. The top base 100 has an upper end integrally defining two trough holes 104, and a pressure outlet hole 105 and a pressure inlet hole 106 located between the two through holes 104. The two through holes 104 are each respectively fitted with a female fire electromagnetic valve 102 and a main fire electromagnetic valve 101. The main fire electromagnetic valve 101 has its top provided with a pressure regulating knob 103, wherein the female fire electromagnetic valve 102 is used to control movement of the fixing piece 201 which is located above the female base 400 and the main fire electromagnetic valve 101 is used to control movement of the fixing piece 201 which is located under the top base 100. The pressure outlet hole 105 and the pressure inlet hole 106 are each respectively screwed with a bolt 107.

The aluminum plate 300 is a rectangular piece, and has a center defining an air draining hole 301. The air draining hole 301 has one side defining a rectangular hole 302, and a plurality of circular holes 303.

The sealing washer 304 is a rectangular piece, and has a center defining an air draining hole 301. The air draining hole 301 has one side defining a rectangular hole 302, and a plurality of circular holes 303.

The rubber washer 203 is an oblong piece, and has a center integrally formed with a fixing bolt 204, and two ends each defining an air outlet hole 205, and a periphery defining a plurality of draining holes 206.

The fixing piece 201 is an oblong disk, and has a center defining a locking hole 202, and two ends each defining an air outlet hole 205.

The female base 400 is substantially rectangular, and has an inner portion integrally formed with a plurality rib walls for separating the inner portion into a first air storing chamber 408, a second air storing chamber 409, and a third air storing chamber 410. The female base 400 has one side defining a female fire air outlet hole 401 and a main fire air outlet hole 402, and the other side defining a fixing hole 405 and an air inlet hole 404, and has two ends each defining a side hole 403. The first air storing chamber 408 communicates with the air inlet hole 404. The inner portion of the female base 400 defines a channel 418 so that the second air storing chamber 409 communicates with the female fire air outlet hole 401 The female base 400 has a bottom defining an oblong hole 407. The oblong hole 407 has a bottom defining an air draining hole 419. A control bolt 411 passes through the fixing hole 405. The control bolt 411 has one end with a semi-cylindrical shape, and the other end fitted with a washer 413, and has a tail end screwed with a wrench 412. An air pressure valve 414 is secured in the first air storing chamber 408. The air pressure valve 414 is a piece having a center provided with a protruding knob 415, and the semi-cylindrical end of the control bolt 411 is rested on a lower end of the air pressure valve 414.

The protective plate 417 is substantially rectangular, and has a center defining an oblong hole 407. The oblong hole 407 has a center defining a circular recess 406.

In assembly, the oblong holes 407 of the top base 100 and the female base 400 each respectively receive a rubber washer 203, thereby closing the oblong hole 407 by the rubber washer 203. The fixing bolt 204 of the rubber washer 203 is fitted with a fixing piece 201. The fixing piece 201 defines a circular recess 406 for receiving a spring 200, so that the fixing piece 201 may be displaced on the fixing bolt 204. Then, the protective plate 417 is used for sealing the rubber washer 203 and the fixing piece 201 in the oblong hole 407 of the female base 400. Then, the top base 100 is screwed on a top of the female base 400, with the aluminum plate 300 and the sealing washer 304 being clamped between the top base 100 and the female base 400. The plurality of air storing chambers of the female base 400 are closed while the rubber washer 203 and the fixing piece 201 of the top base 100 are sealed in the oblong hole 407 of the female base 400 by provision of the aluminum plate 300 and the sealing washer 304. The gas valve switch structure of the gas stove achieves a gas triple safety switch by provision of the two electromagnetic valves and the control bolt.

It should be clear to those skilled in the art that further embodiments may be made without departing from the scope of the present invention.

What is claimed is:

1. A gas valve of the type configured to control a gas flow to a pilot burner and to a main burner, comprising:

a first base member having opposing first and second sides;

a second base member coupled to the first side of the first base member;

first and second electromagnetic valves mounted to the second base member;

a first adjustable member positioned adjacent to the second side of the first base member and movable to control gas flow to the pilot burner; and a second adjustable member positioned adjacent to the first side of the first base member and movable to control gas flow to the main burner;

whereby the first electromagnetic valve controls the first adjustable member and the second electromagnetic valve controls the second adjustable member.

2. The value of claim 1, further comprising an air pressure valve positioned in the first base member and movable between open and closed positions.

3. The valve of claim 2, further comprising an actuating member mounted to the first base member and configured to actuate the air pressure valve.

4. The valve of claim 1, further comprising a plate structure positioned between the first and second base members that includes a plurality of openings for passage of fluids between the first and second base members.

5. The valve of claim 1, wherein the second electromagnetic valve includes a pressure regulating knob.

6. The valve of claim 1, further comprising a sealing washer positioned between the first and second base members that includes a plurality of openings for passage of fluids between the first and second base members.

7. The valve of claim 1, wherein the first adjustable member includes a first fixing member.

8. The valve of claim 7, wherein the first adjustable member further includes a first washer having a center integrally formed with a fixing bolt, a pair of air outlet holes, and a plurality of draining holes formed therein.

9. The valve of claim 8, wherein the second adjustable member includes a second fixing member.

10. The valve of claim 9, wherein the second adjustable member further includes a second washer having a center integrally formed with a fixing bolt, a pair of air outlet holes, and a plurality of draining holes formed therein.

11. The valve of claim 10, wherein the second fixing member includes a pair of air outlet holes aligned with the pair of air outlet holes of the second washer, and a locking hole configured to receive the fixing bolt of the second washer.

12. The valve of claim 1, further comprising a protective plate positioned adjacent to the first adjustable member and having a recess configured to retain a biasing member.

13. The valve of claim 12, wherein the biasing member biases the first adjustable member towards the first base member.

14. The valve of claim 12, wherein the first base member includes an oblong opening formed in the first side of the first base member, and the protective plate seals the first adjusting member in the oblong hole.

15. The valve of claim 1, wherein the second base member includes an oblong opening sized to receive the second adjustable member.

16. The valve of claim 15, wherein the oblong opening of the second base member includes a recess configured to retain a biasing member.

17. The valve of claim 16, wherein the second biasing member biases the first adjustable member toward the second base member.

18. The valve of claim 1, wherein the second base member includes a pressure inlet hole and a pressure outlet hole.

19. The valve of claim 1, wherein the second base member includes first and second valve recesses configured to receive the first and second electromagnetic valves.

20. The valve of claim 1, wherein the first base member further includes an inner volume and a plurality of walls that divide the inner volume into a plurality of chambers.

21. The valve of claim 20, wherein the plurality of chambers includes first, second, and third storing chambers.

22. The valve of claim 21, wherein the first base member further includes a third side having first and second outlet openings that are in fluid communication with respective first and second electromagnetic valves, and a fourth side having an inlet opening.

23. The valve of claim 22, wherein the first storing chamber is in fluid communication with the inlet opening, the second storing chamber is in fluid communication with the first outlet opening, and the third storing chamber is in fluid communication with the second outlet opening.

24. The valve of claim 23, wherein first adjustable member controls fluid flow into the second storing chamber, and the second adjustable member controls fluid flow into the third storing chamber.

* * * * *